US007360363B2

(12) United States Patent
Mandai et al.

(10) Patent No.: US 7,360,363 B2
(45) Date of Patent: Apr. 22, 2008

(54) PREMIXING NOZZLE, COMBUSTOR, AND GAS TURBINE

(75) Inventors: Shigemi Mandai, Hyogo (JP); Keijirou Saitoh, Hyogo (JP); Katsunori Tanaka, Hyogo (JP); Wataru Akizuki, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 744 days.

(21) Appl. No.: 10/415,649

(22) PCT Filed: Jul. 5, 2002

(86) PCT No.: PCT/JP02/06838

§ 371 (c)(1),
(2), (4) Date: Oct. 31, 2003

(87) PCT Pub. No.: WO03/006887

PCT Pub. Date: Jan. 23, 2003

(65) Prior Publication Data

US 2004/0229178 A1 Nov. 18, 2004

(30) Foreign Application Priority Data

Jul. 10, 2001 (JP) ..... 2001-209935

(51) Int. Cl.
*F23R 3/14* (2006.01)

(52) U.S. Cl. ..... 60/737; 60/748

(58) Field of Classification Search ..... 60/737, 60/738, 740, 748; 431/182, 183
See application file for complete search history.

(56) References Cited

U.S. PATENT DOCUMENTS

| | | | | |
|---|---|---|---|---|
| 4,483,137 | A * | 11/1984 | Faulkner | 60/748 |
| 4,713,938 | A * | 12/1987 | Willis | 60/748 |
| 5,251,447 | A | 10/1993 | Joshi et al. | |
| 5,675,971 | A * | 10/1997 | Angel et al. | 60/748 |
| 5,822,992 | A | 10/1998 | Dean | |

FOREIGN PATENT DOCUMENTS

| | | |
|---|---|---|
| EP | 159153 | 10/1985 |
| EP | 445652 | 9/1991 |
| EP | 902237 | 3/1999 |
| JP | 6-213452 | 8/1994 |
| JP | 08-021627 | 1/1996 |
| JP | 9-101009 | 4/1997 |
| JP | 9-119639 | 5/1997 |
| JP | 2001-25947 | 9/2001 |
| JP | 2002-61842 | 2/2002 |

* cited by examiner

*Primary Examiner*—L. J. Casaregola
(74) *Attorney, Agent, or Firm*—Oblon, Spivak, McClelland, Maier & Neustadt, P.C.

(57) ABSTRACT

A premixing nozzle includes swirler blades for agitating combustion air inside a nozzle body. Each one end of the swirler blades is fitted to the nozzle body, and the other end is connected to a hub, respectively. The tip portion of a fuel nozzle shaft is conical, and a part of the tip portion is arranged inside the hub. A combustion gas flows into the hub from a space between the tip portion of the fuel nozzle shaft and the upstream end of the hub, passes through between the tip portion and the inner peripheral surface of the hub, and flows toward the downstream of the hub.

5 Claims, 13 Drawing Sheets

(a)

(b)

PREMIXING NOZZLE, COMBUSTOR, AND GAS TURBINE

TECHNICAL FIELD

The present invention relates to a gas turbine, and more specifically to a premixing nozzle, a combustor, and a gas turbine that can suppress flashback.

BACKGROUND ART

In recent gas turbine combustors, a premixed combustion method is used from a standpoint of environmental protection because the premixed combustion method is more advantageous for a reduction of thermal NOx. The premixed combustion method is for premixing fuel and excessive air and burning the premixed fuel, which can easily reduce NOx, because the fuel burns under a diluted condition in all spaces in the combustor. The premixing combustor in a gas turbine is explained and a premixing nozzle used heretofore is explained as well.

FIG. 14 shows a premixing combustor and a premixing nozzle in a gas turbine used heretofore. A combustion nozzle block 505 is provided in a combustor casing 600, with a certain space from the combustor casing, and a pilot corn 60 for forming diffusion flame is provided in the central part of the combustion nozzle block 505. This combustion nozzle block 505 is inserted in an inner cylinder 515 of a combustion chamber. The pilot corn 60 forms the diffusion flame by allowing a pilot fuel supplied from a pilot fuel supply nozzle 62 to react with combustion air supplied from a compressor (not shown).

Though not clear from FIG. 14, eight premixing nozzles 820 for forming premixed flame are provided around the pilot corn 60. Swirler blades 320 for swirling the combustion air are attached inside a nozzle body 10. The swirler blades 320 swirl the combustion air fed from the compressor (not shown) to produce a rotational flow in the combustion air, thereby mixing the fuel and the combustion air. A hub 120 for holding a fuel nozzle shaft 220, described later, is fitted in the central part of the swirler blades 320.

The fuel nozzle shaft 220 for supplying the fuel is inserted into the hub 120, and is supported substantially at the center of the nozzle body 10 by the swirler blades 320 and the hub 120. The fuel nozzle shaft 220 is provided with hollow gas fuel supply blades 29, and the gas fuel fed from a fuel supply path provided in the fuel nozzle shaft 220 is guided to the inside of the gas fuel supply blades 29. The gas fuel is then supplied from gas fuel supply holes 49 provided on the sides of the gas fuel supply blades 29 into the nozzle body 10.

In the process that the fuel supplied to the nozzle body 10 flows through inside of the body to the downstream, the fuel is sufficiently mixed with the combustion air swirled by the swirler blades 320 to form a premixed gas. This premixed gas is injected from an outlet 10*a* of the nozzle body 10 into the inner cylinder 515 of the combustion chamber, and ignited by high temperature combustion gas exhausted from the diffusion flame to form premixed gas combustion flame. High temperature and high pressure combustion gas is exhausted from the premixed gas flame, and is guided to a first stage nozzle of a turbine through a combustor tailpipe (not shown).

The premixing nozzle 820 used heretofore in the premixing combustor is for promoting mixture of the fuel and the combustion air by swirling the combustion air by the swirler blades 320. However, when the combustion air is swirled by the swirler blades 320, the flow velocity near the center of the nozzle body 10 decreases due to a centrifugal force derived from the swirls (see FIG. 3(*a*)). When the flow velocity decreases near the center of the nozzle body 10, the premixed gas tends to flow backward to the part where the flow velocity is low. As a result, flashback occurs, and the nozzle body 10 and the fuel nozzle shaft 220 may be burnout. This damage by burning shortens the life of the premixing nozzle, and hence repair or replacement is required frequently, causing a problem in that labor hour is required for the maintenance.

It is an object of the present invention to solve at least the problems in the conventional technology.

DISCLOSURE OF THE INVENTION

The premixing nozzle for a gas turbine combustor according to one aspect of this invention includes a swirler blade inside a nozzle body, a tubular hub that is connected to the swirler blade and has a bore through which a combustion gas is passed, and a fuel nozzle shaft that is located inside the nozzle body and is coaxial with the hub.

The premixing nozzle for a gas turbine combustor according to another aspect of this invention includes a swirler blade inside a nozzle body, a tubular hub connected to the swirler blade, a fuel nozzle shaft, and a flow deflection unit that is located inside the nozzle body and guides a combustion gas to a center of the nozzle body.

The premixing nozzle according to still another aspect of this invention includes a nozzle body, a plurality of swirler blades with one ends fitted to an inner wall of the nozzle body and the other ends opened, and a fuel nozzle shaft having a portion arranged in a space surrounded by the ends of the swirler blades so that a combustion gas is passed through the space along the fuel nozzle shaft.

The combustor for a gas turbine according to still another aspect of this invention includes an inner cylinder of the combustor having a Premixing nozzle. The premixing nozzle includes a swirler blade inside a nozzle body, a tubular hub that is connected to the swirler blade and has a bore through which a combustion gas is passed, and a fuel nozzle shaft that is located inside the nozzle body and is coaxial with the hub. The combustor also includes a cylindrical combustion chamber that has the inner cylinder on an inlet side thereof, and burns a premixed gas injected from the premixing nozzle to form a combustion gas.

The combustor for a gas turbine according to still another aspect of this invention includes an inner cylinder of the combustor having a premixing nozzle. The premixing nozzle includes a swirler blade inside a nozzle body, a tubular hub connected to the swirler blade, a fuel nozzle shaft, and a flow deflection unit that is located inside the nozzle body and guides a combustion gas to a center of the nozzle body. The combustor also includes a cylindrical combustion chamber that has the inner cylinder on an inlet side thereof, and burns a premixed gas injected from the premixing nozzle to form a combustion gas.

The combustor for a gas turbine according to still another aspect of this invention includes an inner cylinder of the combustor having a premixing nozzle. The premixing nozzle includes a nozzle body, a plurality of swirler blades with one ends fitted to an inner wall of the nozzle body and the other ends opened, and a fuel nozzle shaft having a portion arranged in a space surrounded by the ends of the swirler blades so that a combustion gas is passed through the space along the fuel nozzle shaft. The combustor also includes a cylindrical combustion chamber that has the inner cylinder on an inlet side thereof, and burns a premixed gas injected from the premixing nozzle to form a combustion gas.

The gas turbine according to still another aspect of this invention includes a compressor that compresses air to produce combustion air, and a gas turbine combustor that forms a combustion gas by mixing a fuel with the combustion air fed from the compressor to form a mixed gas and burning a premixed gas as the mixed gas. The gas turbine combustor includes an inner cylinder of the combustor having a premixing nozzle that includes a swirler blade inside a nozzle body, a tubular hub that is connected to the swirler blade and has a bore through which a combustion gas is passed, and a fuel nozzle shaft that is located inside the nozzle body and is coaxial with the hub. The gas turbine combustor also includes a cylindrical combustion chamber that has the inner cylinder on an inlet side thereof, and burns a premixed gas injected from the premixing nozzle to form a combustion gas. The gas turbine also includes a turbine in which a rotational driving force is generated by injecting the combustion gas formed by the gas turbine combustor.

The gas turbine according to still another aspect of this invention includes a compressor that compresses air to produce combustion air, and a gas turbine combustor that forms a combustion gas by mixing a fuel with the combustion air fed from the compressor to form a mixed gas and burning a premixed gas as the mixed gas. The gas turbine combustor includes an inner cylinder of the combustor having a premixing nozzle that includes a swirler blade inside a nozzle body, a tubular hub that is connected to the swirler blade and has a bore through which a combustion gas is passed, and a fuel nozzle shaft that is located inside the nozzle body and is coaxial with the hub. The gas turbine combustor also includes a cylindrical combustion chamber that has the inner cylinder on an inlet side thereof, and burns a premixed gas injected from the premixing nozzle to form a combustion gas. The gas turbine also includes a turbine in which a rotational driving force is generated by injecting the combustion gas formed by the gas turbine combustor.

The gas turbine according to still another aspect of this invention includes a compressor that compresses air to produce combustion air, and a gas turbine combustor that forms a combustion gas by mixing a fuel with the combustion air fed from the compressor to form a mixed gas and burning a premixed gas as the mixed gas. The gas turbine combustor includes an inner cylinder of the combustor having a premixing nozzle that includes a nozzle body, a plurality of swirler blades with one ends fitted to an inner wall of the nozzle body, and the other ends opened, and a fuel nozzle shaft having a portion arranged in a space surrounded by the ends of the swirler blades so that a combustion gas is passed through the space along the fuel nozzle shaft. The gas turbine combustor also includes a cylindrical combustion chamber that has the inner cylinder on an inlet side thereof, and burns a premixed gas injected from the premixing nozzle to form a combustion gas. The gas turbine also includes a turbine in which a rotational driving force is generated by injecting the combustion gas formed by the gas turbine combustor.

BEST MODE FOR CARRYING OUT THE INVENTION

The present invention is explained in detail with reference to the drawings. It is noted that the present invention is not limited by embodiments of the present invention. Further, components in the embodiments include ones that can be assumed easily by those skilled in the art.

Figure 1:
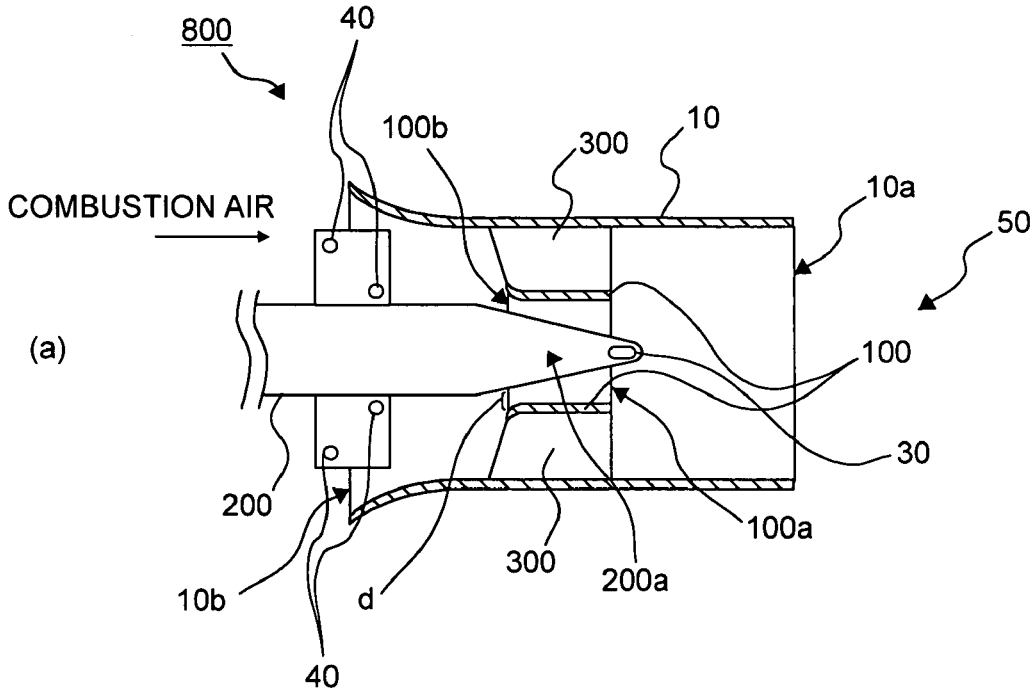
FIG. 1 shows a premixing nozzle of a gas turbine combustor according to a first embodiment of this invention.
Figure 1:
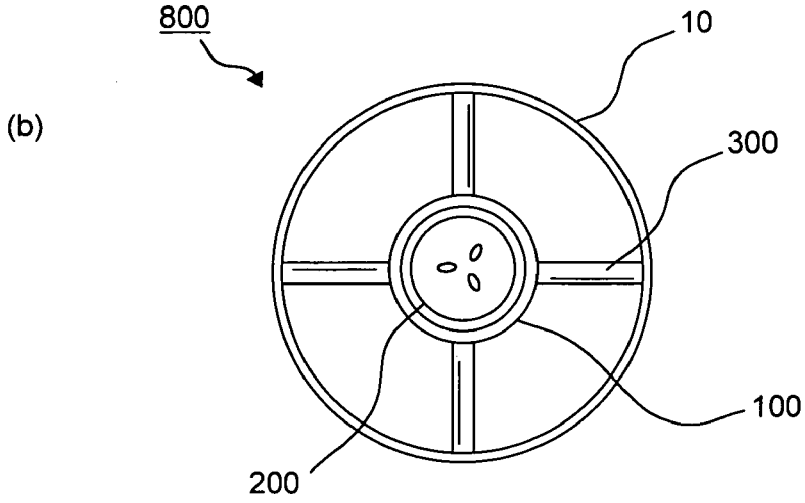

FIG. 1 shows a premixing nozzle of a gas turbine combustor according to a first embodiment of this invention. This premixing nozzle has a feature in that a tip portion of a fuel nozzle shaft that is tapered toward a tip of the shaft is arranged in the inner periphery of a hub of a swirler, to allow the combustion air to flow into a gap between the tip of the fuel nozzle shaft and the inner peripheral surface of the hub of the swirler. The flow velocity near the center of a nozzle body is increased by the combustion air, to thereby bring the flow velocity distribution in the nozzle body close to a uniform state.

Figure 2:
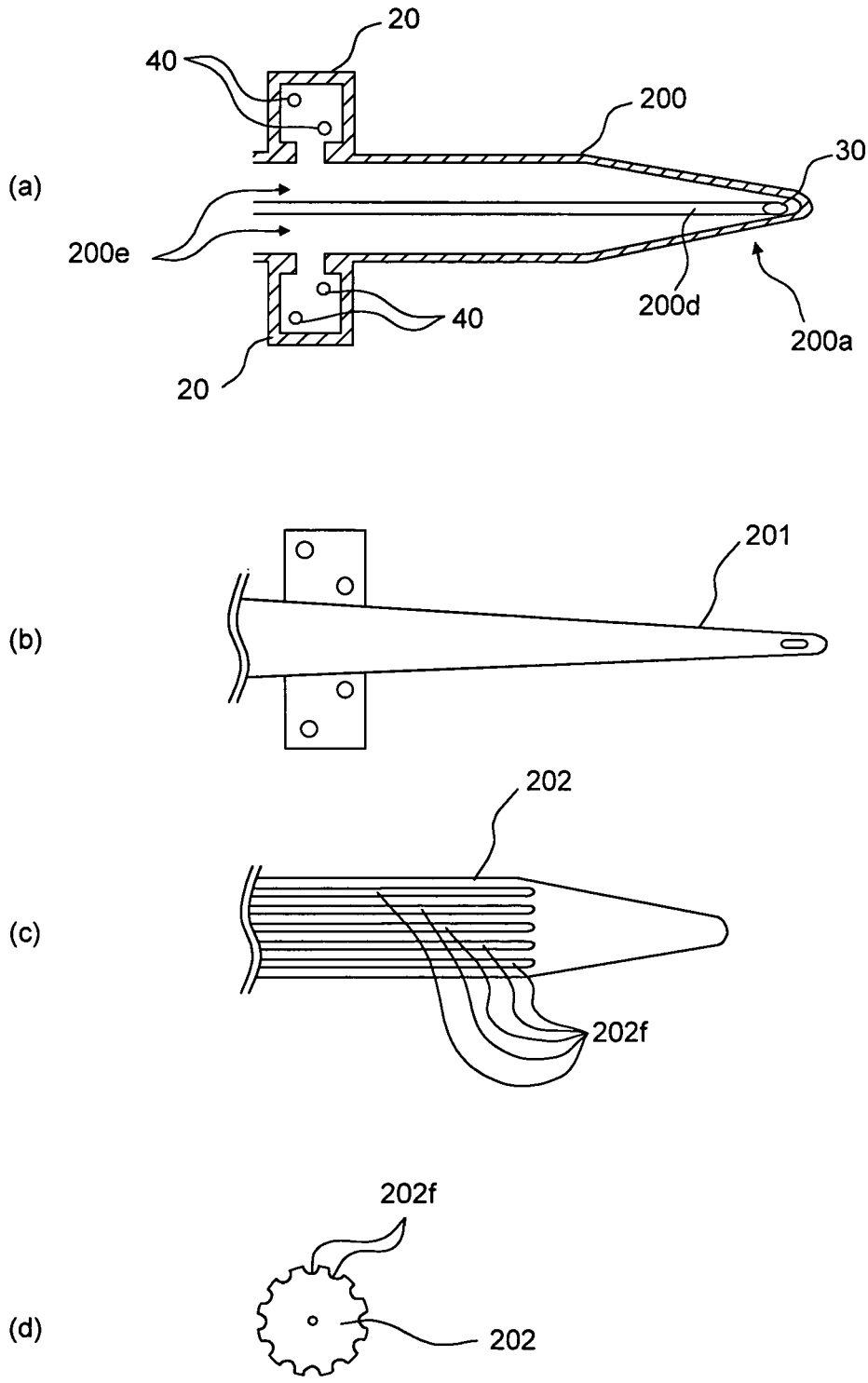
FIG. 2 shows a fuel nozzle shaft used in the premixing nozzle.

A premixing nozzle 800 according to the first embodiment includes a fuel nozzle shaft 200 of a system in which a liquid fuel such as light oil and heavy oil, and a gas fuel such as natural gas can be supplied to the combustion air as combustion gas. FIG. 2 shows a fuel nozzle shaft used in the premixing nozzle. As shown in FIG. 2(*a*), the fuel nozzle shaft 200 has a liquid fuel path 200*d* and a gas fuel path 200*e* therein, in order to supply the gas fuel and the liquid fuel. The liquid fuel is supplied to the nozzle body from a liquid fuel supply hole 30 provided at the tip portion 200*a* of the fuel nozzle shaft 200, and is mixed with the combustion gas.

The gas fuel is guided to hollow gas fuel supply blades 20 fitted in the upstream of the fuel nozzle shaft 200, and then injected to the combustion air from gas fuel supply holes 40 provided on the sides of the gas fuel supply blades 20, to thereby form a combustion gas as a mixed gas of the gas fuel and the combustion air. It is noted that the fuel nozzle shaft that can be used in the first embodiment is not limited thereto, and may be a system of supplying only a gas fuel or only a liquid fuel (hereinafter, the same). Further, the gas fuel may be supplied using the gas fuel supply blades 20, or may be supplied by providing gas fuel supply holes 40 in the fuel nozzle shaft 200 (hereinafter, the same).

The tip portion 200*a* of the fuel nozzle shaft 200 is tapered so that the tip portion 200*a* becomes thinner toward the tip of the fuel nozzle shaft 200, in order to let the combustion gas flow smoothly. As shown in FIG. 2(*a*), only the tip portion 200*a* of the fuel nozzle shaft 200 may be tapered, or as shown in FIG. 2(*b*), the whole fuel nozzle shaft 201 may be tapered so as to become thinner toward the tip. In this manner, the sectional area through which the combustion gas passes gradually changes over the whole fuel nozzle shaft 201, and therefore separation of the combustion gas can be suppressed to allow the combustion gas to flow more smoothly.

The premixing nozzle 800 includes swirler blades 300 for agitating the combustion gas in the nozzle body 10 (see FIG. 1). Only one swirler blade 300 can obtain the action of agitating the combustion air, but it is desired to provide a plurality of swirler blades in order to agitate the combustion gas more effectively. As shown in FIG. 1(*b*), four swirler blades 300 are used in this example. A hub 100 is fitted to the central portion of the swirler blades 300, to thereby connect the swirler blades 300 with each other to increase the rigidity as a whole. The hub 100 also has a function of restricting the movement of the fuel nozzle shaft 200, when the fuel nozzle shaft 200 moves due to vibrations during the operation.

The fuel nozzle shaft 200 is arranged such that a part of the tip portion 200*a* is arranged inside the hub 100. The combustion air fed from a compressor (not shown) flows into the hub 100 from between the tip portion 200*a* of the fuel nozzle shaft 200 and an upstream end 100*b* of the hub 100, passes through between the tip portion 200*a* and the inner peripheral surface of the hub 100, to flow toward an end 100*a* on the outlet side of the hub 100. In other words, the space existing between the tip portion 200*a* of the fuel nozzle shaft 200 and the inner peripheral surface of the hub 100 is used as a path for the combustion gas. If the spacing d of this space is set to be twice to three times the size of the conventional spacing, there is an advantageous effect of decreasing the low velocity region in the nozzle body 10. Specifically, it is desired that the space that has been heretofore from about 1.0 to 1.5 mm is set to be from 2.0 to 3.0 mm or larger. The spacing d may be at least one fourth of the diameter of the fuel nozzle shaft 200.

However, since it is desired that the size of the combustor is as small as possible, the diameter of the nozzle body 10 cannot be increased unreasonably, and since it is necessary to provide a fuel path inside the fuel nozzle shaft 200, the diameter thereof cannot be decreased too much. Further, when the flow velocity in the central part of the nozzle body 10 is at least one half of the mean flow velocity inside the nozzle body 10, flashback hardly occurs. Therefore, the spacing d is determined within the range that the flow velocity in the central part of the nozzle body 10 satisfies this condition, and within the range satisfying the design requirement.

The combustion air fed from the compressor (not shown) flows from an inlet 10*b* of the nozzle body 10, is swirled by the swirler blades 300, and then flows into the nozzle body 10. In this process, the combustion air is sufficiently mixed with the gas fuel supplied from the gas fuel supply holes 40 and the liquid fuel supplied from the liquid fuel supply hole 30, to form a premixed gas. The premixed gas is injected into a combustion chamber 50 from an outlet 10*a* of the nozzle body 10, and ignited by diffusion flame formed by a pilot corn (not shown), to form premixed flame.

Figure 3:
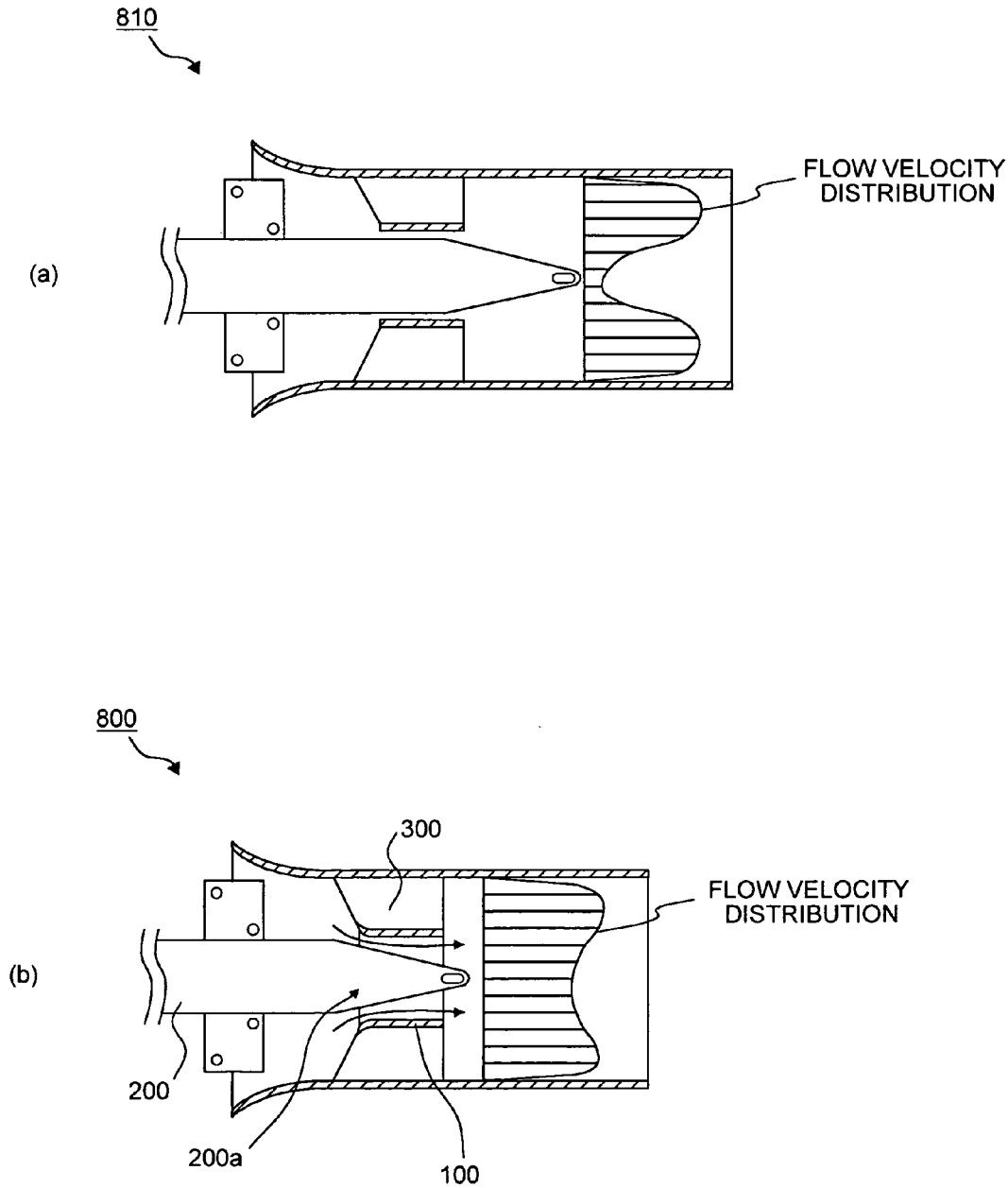
FIG. 3 shows axial flow velocity distribution in nozzle bodies of a conventional premixing nozzle and the premixing nozzle according to the first embodiment.

FIG. 3 shows the axial flow velocity distribution in nozzle bodies of a conventional premixing nozzle and the premixing nozzle according to the first embodiment. As shown in FIG. 3(*a*), in the conventional premixing nozzle 810 (see FIG. 14), the flow velocity distribution has a low velocity region in the central part of the nozzle body, affected by the centrifugal force due to the swirl. However, as described above, in the premixing nozzle 800 according to the first embodiment, a part of the combustion gas is made to flow from the space between the tip portion 200*a* of the fuel nozzle shaft 200 and the inner peripheral surface of the hub 100. By the combustion gas flowing from this space, in the axial flow velocity distribution in the nozzle body according to the first embodiment, as shown in FIG. 3(*b*), the flow velocity in the central part of the nozzle body according to the first embodiment can be increased, as compared with the conventional premixing nozzle. Therefore, a backflow of the premixed gas due to the low velocity region generated near the center of the nozzle body can be suppressed, thus, suppressing the occurrence of flashback.

In the conventional premixing nozzle, the low flow velocity region exists near the tip portion of the fuel nozzle shaft, and hence premixed flame tends to be stabilized near the tip portion. However, if the premixed flame is stabilized in this portion, the evaporation time becomes short when a liquid fuel such as light oil is used, and a mixing length with the air also becomes short, thereby the liquid fuel is not sufficiently mixed with the combustion air. As a result, occurrence of NOx may not be suppressed sufficiently. When the gas fuel is used, the mixing length with the combustion air becomes short, and therefore mixing of these may be insufficient, thereby a portion where the fuel concentration is high burns, to produce a locally high temperature portion. As a result, occurrence of NOx may not be suppressed sufficiently.

In the premixing nozzle according to the first embodiment, the flow velocity in the low flow velocity region in the central part of the nozzle body becomes higher than that of the conventional premixing nozzle, and hence the premixed flame is stabilized in the downstream of the outlet of the nozzle body. Therefore, when the liquid fuel is used, the evaporation time and the mixing length can be made sufficient. As a result, occurrence of the locally high temperature portion due to nonuniform mixing of the fuel can be suppressed. Therefore, occurrence of NOx can be decreased as compared with the conventional premixing nozzle. From the same reason, when the gas fuel is used, the mixing length of the gas fuel and the combustion gas can be made sufficient, and as a result, occurrence of NOx can be decreased as compared with the conventional premixing nozzle.

In this premixing nozzle, as shown in FIG. 1(*a*), the tapered tip portion 200*a* of the fuel nozzle shaft 200 is arranged inside the hub 100. Therefore, even if the diameter of the hub 100 is decreased, the space formed between the fuel nozzle shaft 200 and the inner periphery of the hub 100 can be ensured by adjusting the position of the tip portion 200*a* of the fuel nozzle shaft 200. Consequently, the length of the swirler blade 300 can be increased by decreasing the diameter of the hub 100, thus, stronger swirls can be provided to the combustion gas. As a result, the fuel and the combustion gas can be sufficiently agitated to form a uniform premixed gas, and hence occurrence of NOx can be suppressed by minimizing the occurrence of the locally high temperature portion at the time of combustion.

A space for passing the combustion gas may be provided between the fuel nozzle shaft and the inner peripheral surface of the hub, by decreasing the length of the swirler blade than usual. As shown in FIGS. 2(*c*) and 2(*d*), grooves 202*f* may be provided around the fuel nozzle shaft 202, to let the combustion gas pass through these grooves 202*f*.

Figure 4:
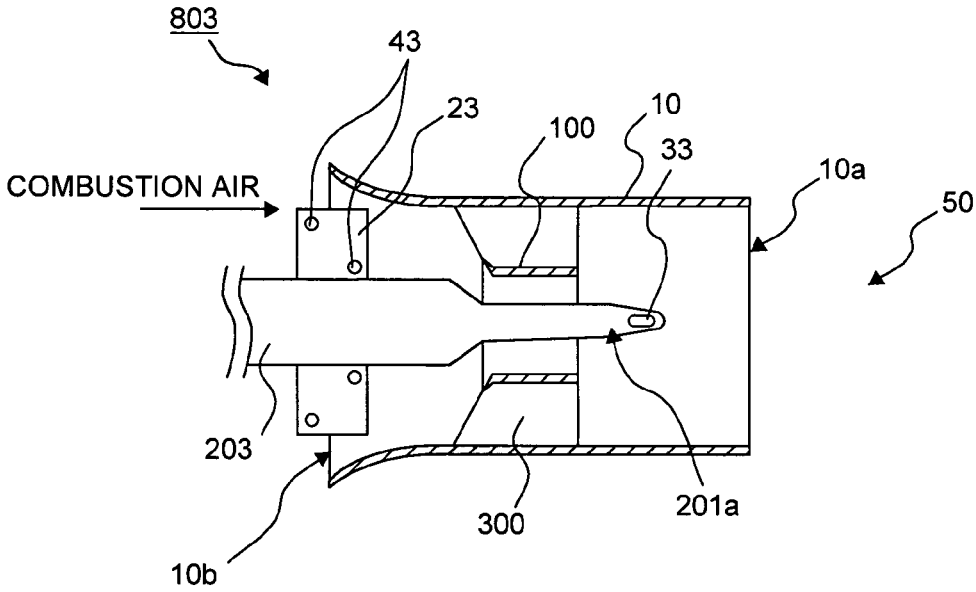
FIG. 4 is an axial cross section of a first modified example of the premixing nozzle according to the first embodiment.

FIG. 4 is an axial cross section of a first modified example of the premixing nozzle according to the first embodiment. This premixing nozzle has a feature in that a part of the fuel nozzle shaft is made thinner than other parts, and this part is arranged on the inner periphery of the hub of the swirler, and the space existing between these two is assigned as a path for the combustion air. The combustion air passes from this space toward the downstream of the hub of the swirler.

The fuel nozzle shaft 203 has a configuration such that the diameter of one part is made thinner, and this part is arranged inside the hub 100. The portion that the fuel nozzle shaft 203 is arranged inside the hub 100 is substantially parallel with the inner peripheral surface of the hub 100 and toward the axial directions thereof. Therefore, a gap as the space formed between these two, becomes substantially constant. A liquid fuel supply hole 33 for supplying a liquid fuel to the combustion air is provided at the tip portion 201*a* of the fuel nozzle shaft 203. On the upstream side of the fuel nozzle shaft 203, a gas fuel is supplied from gas fuel supply holes 43 provided on the sides of gas fuel supply blades 23 to the combustion air.

The combustion air flowing in from the inlet 10*b* of the nozzle body 10 is supplied with a gas fuel such as natural gas from the gas fuel supply holes 43 to form a combustion gas, and the combustion gas flows to the downstream in the nozzle body 10. The combustion gas is swirled by the swirler blades 300, to flow in the nozzle body 10 while swirling. A part of the combustion gas flows to the downstream of the hub 100, passing through a gap formed between the fuel nozzle shaft 203 and the inner peripheral surface of the hub 100. This combustion gas and the combustion gas swirled by the swirler blades 300 are joined together in the downstream of the hub 100.

At this time, the combustion gas swirled by the swirler blades 300 swirls at a constant angular velocity. On the other hand, the combustion gas passing through the gap formed between the fuel nozzle shaft 203 and the inner peripheral surface of the hub 100 hardly swirls, and hence it has almost no angular velocity. The combustion gas having passed through the swirler blades 300 and the combustion gas having passed through the space are sufficiently agitated, by a shearing force generated by a difference in this angular velocity.

A liquid fuel is supplied from the liquid fuel supply hole 33 in the downstream of the hub 100. The supplied liquid fuel is sufficiently mixed with the combustion air, because of the swirling effect by the swirler blades 300 and the agitating effect due to a difference in the angular velocity, to form a premixed gas. This premixed gas is injected from the outlet 10*a* of the nozzle body 10 to the combustion chamber 50.

In this premixing nozzle 803, a part of the fuel nozzle shaft 203 is made thin, and this part is arranged inside the hub 100 for the swirler blades 300. Therefore, the space formed between the fuel nozzle shaft 203 and the inner peripheral surface of the hub 100 becomes constant with respect to the flow direction of the combustion gas. In the premixing nozzle 800 (see FIG. 1), since the space formed between the fuel nozzle shaft 200 and the inner peripheral surface of the hub 100 increases toward the flow direction of the combustion gas, the flow velocity of the combustion gas becomes slightly slow when the combustion gas passes through this part.

In this premixing nozzle 803, however, since the space is kept substantially constant with respect to the flow direction, the flow velocity of the combustion gas hardly decreases in this part. Therefore, in the premixing nozzle 803 according to the first modified example, the flow velocity distribution in the nozzle body 10 can be made more uniform as compared with the premixing nozzle 800. As a result, the risk of flashback becomes lower than in the premixing nozzle 800, and the premixed flame can be stabilized in the downstream of the outlet 10*a* of the nozzle body 10 more reliably, thereby occurrence of NOx can be suppressed.

Figure 5:
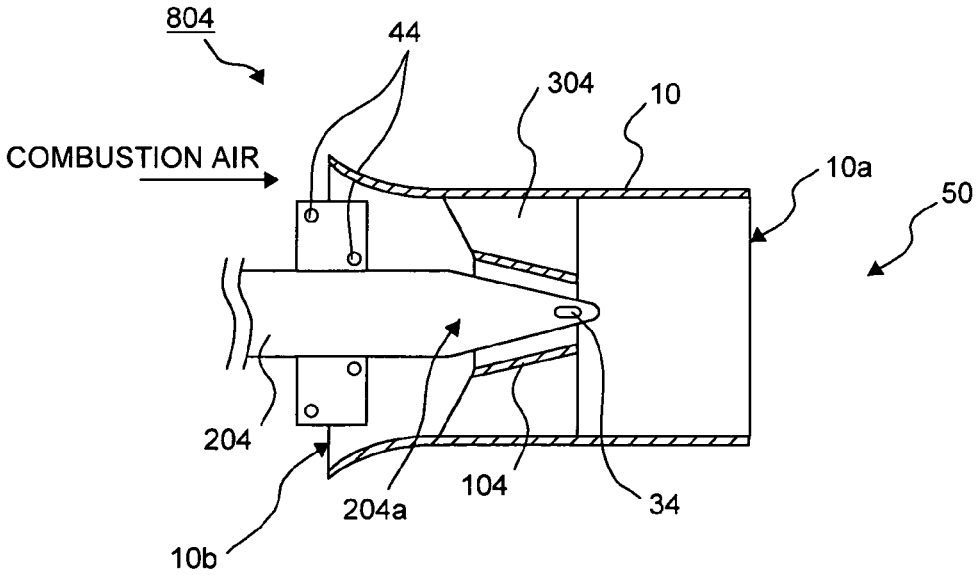
FIG. 5 is an axial cross section of a second modified example of the premixing nozzle according to the first embodiment.

FIG. 5 is an axial cross section of a second modified example of the premixing nozzle according to the first embodiment. In this premixing nozzle, a tip portion of the fuel nozzle shaft tapered toward the tip is arranged in the inner periphery of the hub of the swirler, whose diameter decreases toward the flow direction, so that the combustion gas is allowed to pass through a gap formed between the tip portion of the nozzle shaft and the inner peripheral surface of the hub.

As shown in FIG. 5, the hub 104 connected to one ends of the swirler blades 304 has a diameter decreasing toward the flow direction of the combustion air. The tip portion 204*a* of the fuel nozzle shaft 204 is tapered toward the tip, and this tip portion 204*a* is arranged inside the hub 104. Therefore, the gap between the side face of the tip of the fuel nozzle shaft 204 and the inner peripheral surface of the hub 104 can be maintained in a constant interval.

This gap may be constant over the axial direction of the hub 104, or may be changed over the axial direction. If this gap is decreased toward the downstream of the nozzle body 10, the flow velocity of the combustion gas passing between the hub 104 and the nozzle body 10 becomes slow at the outlet of the hub 104, and the flow velocity of the combustion gas passing through the gap becomes fast at the outlet of the hub 104. Therefore, a velocity difference between these two velocities decreases in the downstream of the swirler blades 304, the flow velocity distribution in the nozzle body 10 can be made more uniform.

The combustion air flowing in from an inlet 10*b* of the nozzle body 10 is supplied with a gas fuel from gas fuel supply holes 44 to form a combustion gas, and a part of the gas is swirled by the swirler blades 304. A part of the remaining combustion air flows to the downstream of the hub 104, passing through a space formed between the inner peripheral surface of the hub 104 and the tip portion 204*a* of the fuel nozzle shaft 204. The combustion gas having passed through the swirler blades 304 and the combustion gas having passed through the space are joined together in the downstream of the hub 104, and a liquid fuel such as light oil is also supplied from a liquid fuel supply hole 34, to form a premixed gas. This premixed gas is injected into the combustion chamber 50 from the outlet 10*a* of the nozzle body 10.

In this premixing nozzle 804, since the diameter of the hub 104 decreases toward the downstream, the sectional area between the nozzle body 10 and the hub 104 increases along the downstream. Therefore, the flow velocity of the combustion gas passing through between the nozzle body 10 and the hub 104, that is, of the combustion gas passing through the swirler blades 304 decreases on the outlet side than on the inlet side. Accordingly, a difference between the flow velocity of the combustion gas passing through the swirler blades 304 and the flow velocity of the combustion gas passing through the gap between the hub 104 and the fuel nozzle shaft 204 decreases. Therefore, a flow velocity distribution inside the nozzle body 10 becomes more uniform than in the premixing nozzle 803 according to the first modified example. As a result, in the premixing nozzle according to the second modified example, the risk of flashback decreases, and the premixed flame can be stabilized in the downstream more reliably than the outlet 10*a* of the nozzle body 10, thereby occurrence of NOx can be further suppressed.

Figure 6:
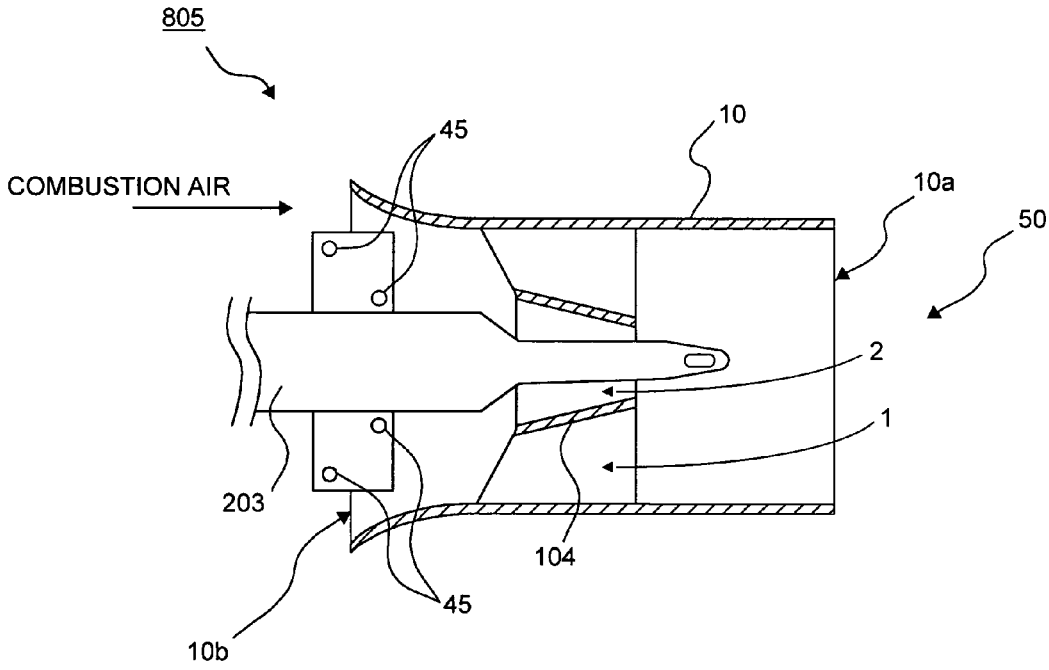
FIG. 6 is an axial cross section of a third modified example of the premixing nozzle according to the first embodiment.

FIG. 6 is an axial cross section of a third modified example of the premixing nozzle according to the first embodiment. In this premixing nozzle, a part of the fuel nozzle shaft is made thinner than the other part, and this portion is arranged in the inner periphery of the hub of the swirler, whose diameter is decreased toward the flow direction, and the gap existing between these is assigned as a combustion air path. In other words, the premixing nozzle 805 according to the third modified example is obtained by combining the fuel nozzle shaft 203 (see FIG. 4) according to the first modified example with the hub 104 (see FIG. 5) according to the second modified example.

A gas fuel is supplied from gas fuel supply holes 45 to the combustion air fed from the compressor (not shown), to form a combustion gas. This combustion gas flows, branching to a first channel 1 formed between the nozzle body 10 and the hub 104, and a second channel 2 formed between the fuel nozzle shaft 203 and the inner peripheral surface of the hub 104. As shown in FIG. 6, a sectional area of the first channel 1 for passing the combustion gas increases toward the downstream of the nozzle body 10, and on the contrary, a sectional area of the second channel 2 for passing the combustion gas decreases.

Therefore, the flow velocity of the combustion gas having passed through the first channel 1 becomes slower at the outlet of the channel than at the inlet thereof, but the flow velocity of the combustion gas having passed through the second channel 2 becomes faster at the outlet of the channel than at the inlet thereof. Therefore, the flow velocity distribution in the nozzle body 10 becomes more uniform than in the premixing nozzle 804 (see FIG. 5) according to the second modified example. As a result, in the premixing nozzle according to the third modified example, the risk of flashback further decreases, and the premixed flame can be stabilized in the downstream more reliably than the outlet 10*a* of the nozzle body 10, thereby occurrence of NOx can be further suppressed.

Figure 7:
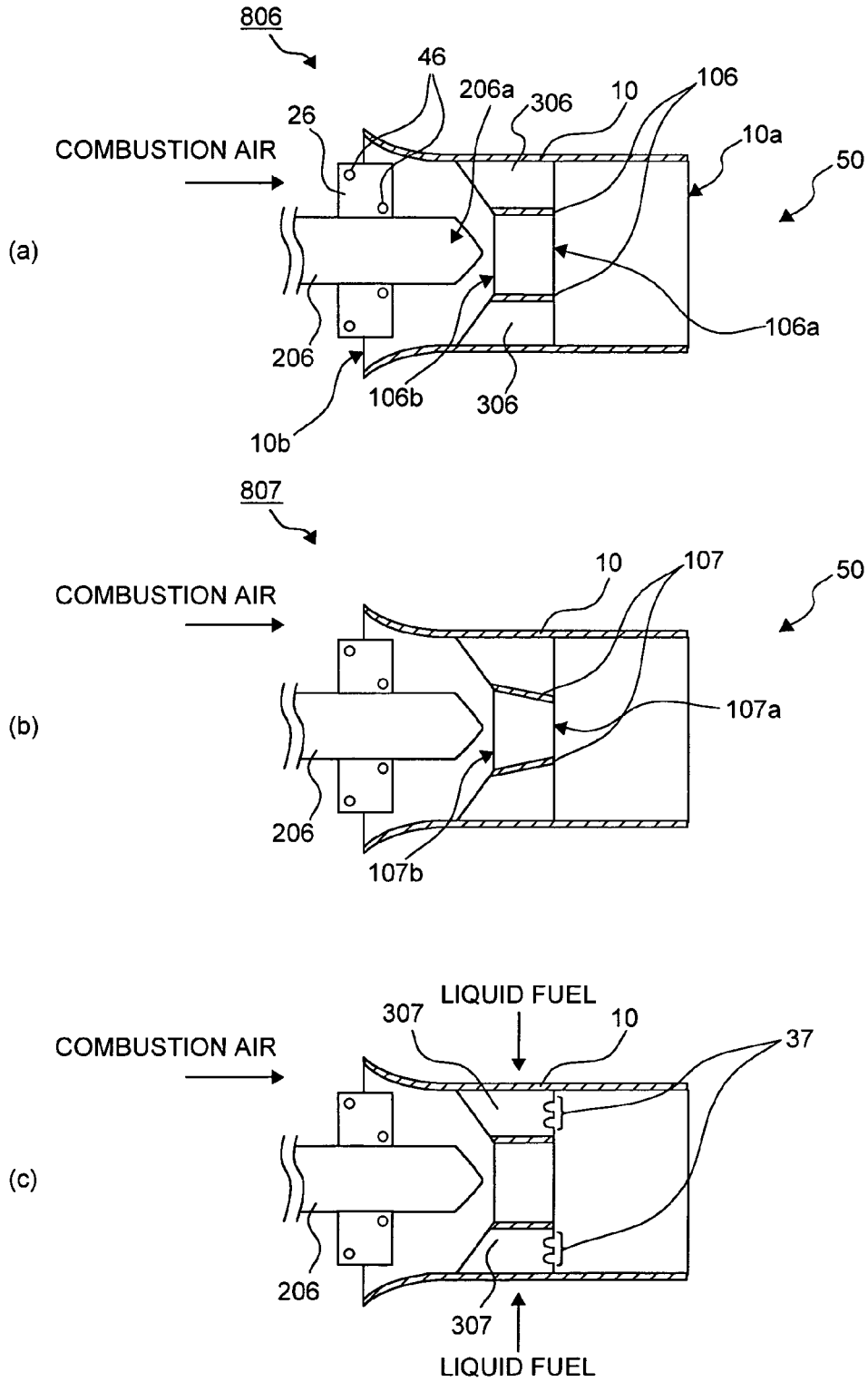
FIG. 7 is an axial cross section of a premixing nozzle according to a second embodiment of the present invention.

FIG. 7 is an axial cross section of a premixing nozzle according to a second embodiment of the present invention. This premixing nozzle has a feature in that a tip of the fuel nozzle shaft is arranged in the upstream of the inlet of the hub. This premixing nozzle 806 is particularly suitable for a case in which the gas fuel is used singly. Therefore, an example in which the premixed gas is formed only by the gas fuel is explained first.

Swirler blades 306 are fitted inside the nozzle body 10, and the swirler blades 306 have a hub 106 at the central portion thereof. A fuel nozzle shaft 206 has a tip portion 206*a* having a diameter decreasing toward the flow direction, and the tip portion 206*a* is arranged in the upstream of an inlet 106*b* of the hub 106. A gas fuel is supplied from gas fuel supply holes 46 provided in gas fuel supply blades 26 to the combustion air fed from the compressor (not shown), to form a combustion gas.

A part of this combustion gas is swirled by the swirler blades 306 while passing through between the nozzle body 10 and the hub 106. The remaining combustion gas passes through a space formed between the tip 206*a* of the fuel nozzle shaft 206 and the inlet 106*b* of the hub 106, and flows into the hub 106. The bifurcated combustion airs meet again in the downstream of an outlet 106*a* of the hub 106, and these are mixed sufficiently, while flowing to the downstream of the nozzle body 10.

In this premixing nozzle 806, since the flow rate of the combustion gas flowing in the hub 106 can be increased, a flow velocity distribution in the nozzle body 10 can be made uniform. As a result, the occurrence of flashback can be suppressed by suppressing a backflow of the premixed gas. Further, since the premixed gas does not flow backward to the portion where the flow velocity is slow, the premixed flame can be stabilized in the combustion chamber 50. As a result, the mixing length of the gas fuel and the combustion air can be sufficiently ensured, occurrence of NOx can be suppressed by suppressing production of a locally high temperature portion. As shown in FIG. 7(*b*), the diameter of a hub 107 may be decreased toward the downstream. In this manner, the flow velocity of the combustion gas at an outlet 107*a* of the hub 107 becomes faster than the flow velocity at an inlet 107*b* thereof, thereby a flow velocity distribution in the nozzle body 10 can be made more uniform. As a result, occurrence of flashback and occurrence of NOx can be further suppressed.

If a liquid fuel supply hole is provided at the tip portion 206*a* of the fuel nozzle shaft 206 used in this premixing nozzle 806 to supply a liquid fuel, the hub 106 on the downstream side disturbs dispersion of the liquid fuel. Therefore, when the liquid fuel is also burnt in this premixing nozzle 806, as shown in FIG. 7(*c*), hollow swirler blades 307 are used to provide liquid fuel supply holes 37 at the edge of the swirler blades 307, and the liquid fuel may be supplied from these holes 37 to the combustion gas. In this manner, the liquid fuel can be used even in the premixing nozzle according to the second embodiment.

Figure 8:
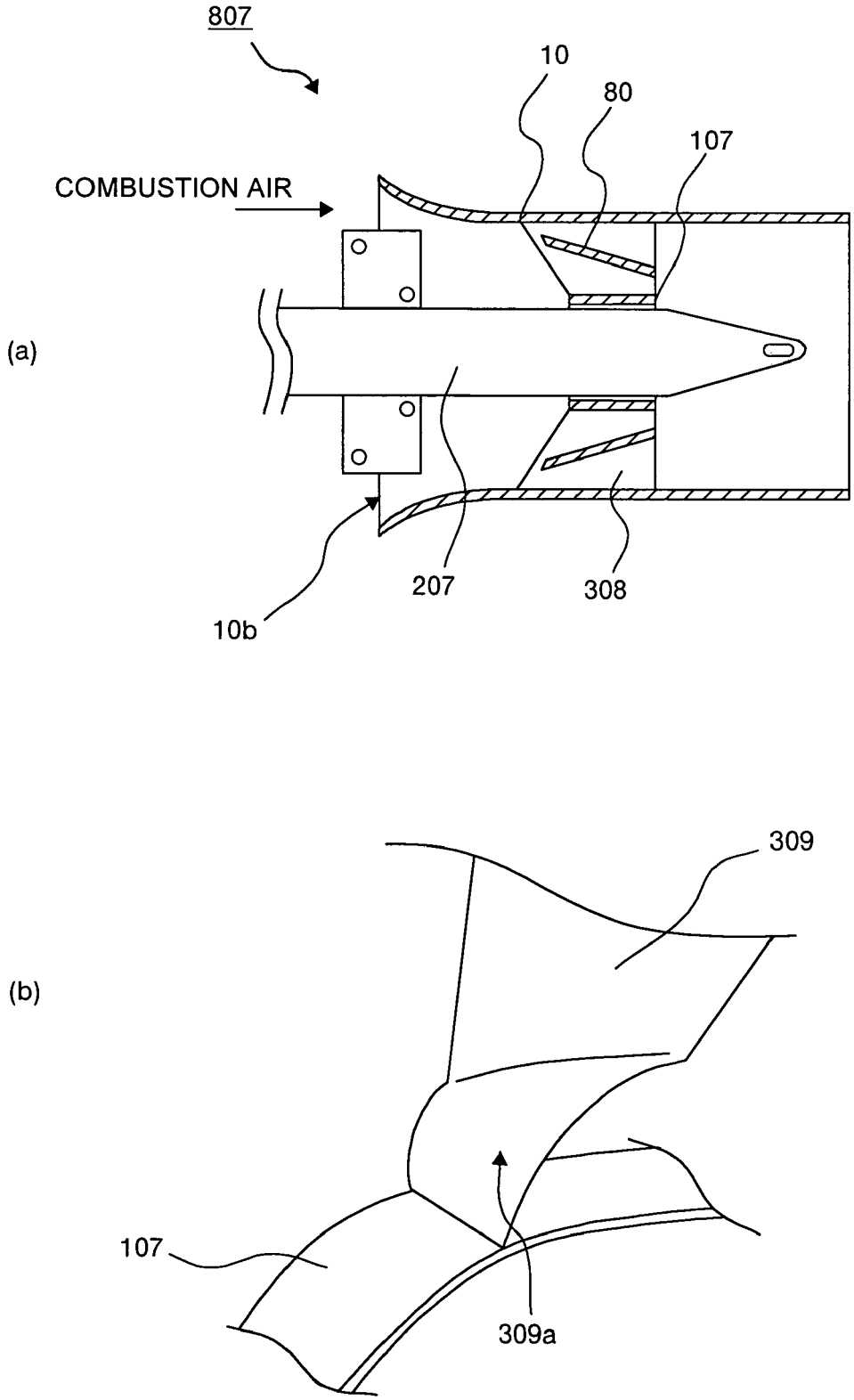
FIG. 8 shows a premixing nozzle according to a third embodiment of the present invention.

FIG. 8 shows a premixing nozzle according to a third embodiment of the present invention. This premixing nozzle has a feature in that a unit for directing the flow direction of the combustion gas toward the center of the nozzle body is provided in the nozzle body. The reason why the low flow velocity region occurs at the center of the nozzle body is that the combustion gas swirled by the swirler flows radially outward of the nozzle body due to the centrifugal force of the swirl. In the premixing nozzle according to the third embodiment, the flow directed outward of the nozzle body is changed inward by the unit that directs the flow direction toward the center of the nozzle body, thereby a flow velocity distribution in the nozzle body is made uniform.

As shown in FIG. 8(*a*), a cylindrical deflection ring 80 having a diameter decreasing toward the flow direction is used for this premixing nozzle 807 as the unit for directing the flow direction toward the center of the nozzle body. This deflection ring 80 is fitted to swirler blades 308. A gas fuel such as natural gas is supplied to the combustion air flowing in from the inlet 10*b* of the nozzle body 10, to form a combustion gas. This combustion gas is swirled by the swirler blades 308 provided in the nozzle body 10. At the same time, a flow toward the center of the nozzle body 10 is given to this combustion gas by the deflection ring 80 fitted to the swirler blades 308.

Since the premixing nozzle 807 according to the third embodiment relieves the centrifugal force due to the swirl by the flow toward the center, a flow velocity distribution in the nozzle body 10 can be made uniform. This premixing nozzle 807 can make the flow velocity distribution in the nozzle body 10 uniform by the deflection ring 80, without increasing the interval between the fuel nozzle shaft 207 and the hub 107. Therefore, even when the fuel nozzle shaft 207 moves due to vibrations, the movement can be suppressed by the hub 107, and hence this premixing nozzle 807 is highly resistant to turbulence such as vibrations, as compared with the premixing nozzle according to the first or second embodiment. Further, the deflection ring 80 also works as a reinforcing member, thereby enabling stable operation by suppressing vibrations of the swirler blades 308 or the like.

In the above example, the deflection ring 80 is fitted to the swirler blades 308, but the deflection ring 80 may be arranged on the downstream side of the swirler blades 308. The deflection ring 80 maybe arranged in the upstream of the swirler blades 308, but in this case, the action of relieving the centrifugal force due to thee swirl becomes slightly weak.

As the unit for directing the flow direction of the combustion gas toward the center of the nozzle body 10, a flow deflection portion 309*a* may be provided on the hub 107 side of the swirler blades 309 as shown in FIG. 8(*b*), and a flow toward the center of the nozzle body 10 may be given to the combustion gas by this portion. By this method, since the structure hardly changes from the conventional premixing nozzle, production and maintenance are possible as an extension of the existing technology.

Figure 9:
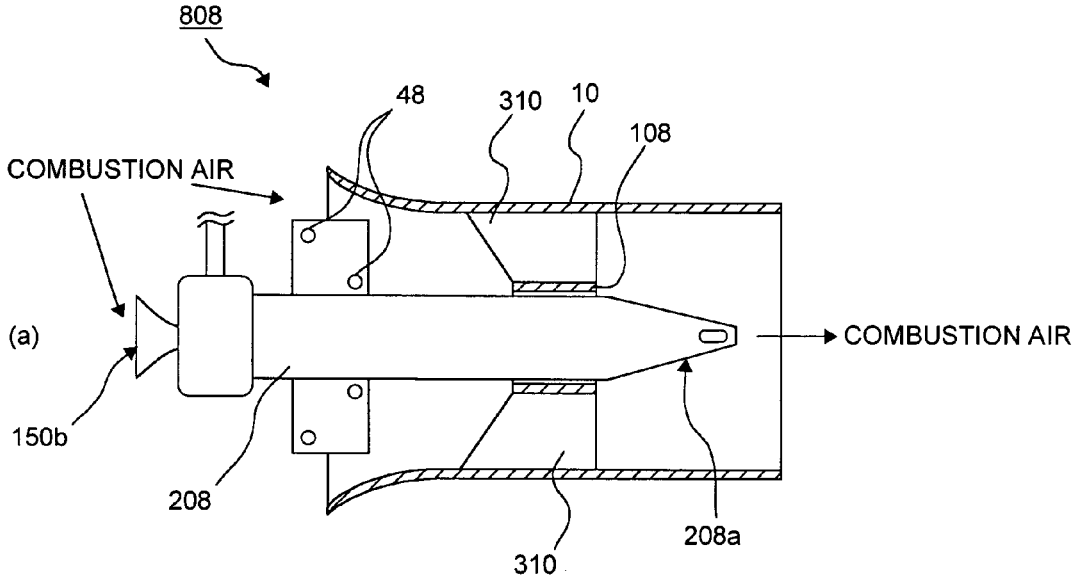
FIG. 9 shows a premixing nozzle according to a fourth embodiment of the present invention.
Figure 9:
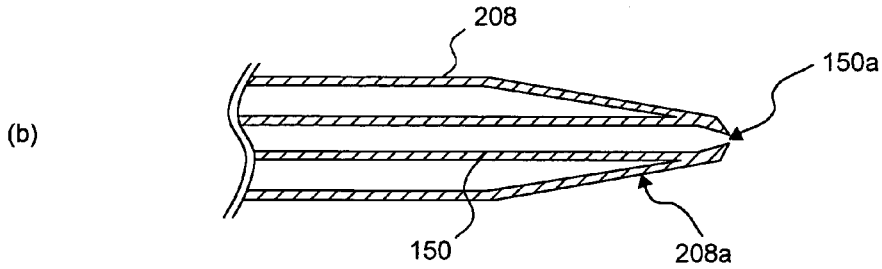

FIG. 9 shows a premixing nozzle according to a fourth embodiment of the present invention. This premixing nozzle has a feature in using a fuel nozzle shaft having a through hole for combustion gas axially penetrating the fuel nozzle shaft. This premixing nozzle 808 includes a fuel nozzle shaft 208 having a through hole for passing the combustion air as the combustion gas, to the downstream of swirler blades 310.

As shown in FIG. 9(*b*), the fuel nozzle shaft 208 is provided with an inner cylinder 150 axially penetrating the fuel nozzle shaft 208, as a through hole for the combustion air. An inlet 150*b* of this inner cylinder 150 is open in the upstream of the fuel nozzle shaft 208 (see FIG. 9(*a*)), and the shape of the inlet 150*b* is in a funnel shape so as to easily take in the combustion air, but the shape is not limited to the funnel shape.

An outlet 150*a* (FIG. 9(*b*)) of the inner cylinder 150 is open at a tip portion 208*a* of the fuel nozzle shaft 208, and the combustion air flowing into the inlet 150*b* flows to the downstream of the swirler blades 310. As shown in FIG. 9(*b*), if a diaphragm is provided at the outlet 150*a* of the inner cylinder 150, the flow velocity of the combustion air can be increased. As a result, a flow velocity distribution in the nozzle body 10 can be made more uniform.

A part of the combustion air fed from the compressor (not shown) flows into the inner cylinder 150 from the inlet 150*b* of the inner cylinder 150. The remaining combustion air forms a combustion gas together with the gas fuel supplied from gas fuel supply holes 48, and the combustion gas flows to the downstream of the nozzle body 10. The combustion gas is swirled by the swirler blades 310, and becomes a rotational flow directed radially outward of the nozzle body 10 due to the centrifugal force of the swirl in the downstream of the swirler blades 310.

If left as it is, the low flow velocity region is formed near the center of the nozzle body 10. However, in the premixing nozzle 808, since the combustion air flows out from the outlet 150*a* of the inner cylinder 150, the flow velocity in the central part of the nozzle body 10 does not decrease. As a result, a flow velocity distribution in the nozzle body 10 is brought close to a uniform state, thereby flashback and NOx can be reduced. In the premixing nozzle 808 according to the fourth embodiment, it is not necessary to set an interval between the fuel nozzle shaft 208 and the hub 108 as large as that of the premixing nozzle according to the first or second embodiment. Therefore, even when the fuel nozzle shaft 208 moves due to vibrations or the like, the movement thereof can be suppressed by the hub 108. As a result, this premixing nozzle 808 is highly resistant to turbulence such as vibrations, and enables stable combustion regardless of the operation condition, as compared with the premixing nozzle according to the first or second embodiment.

Figure 10:
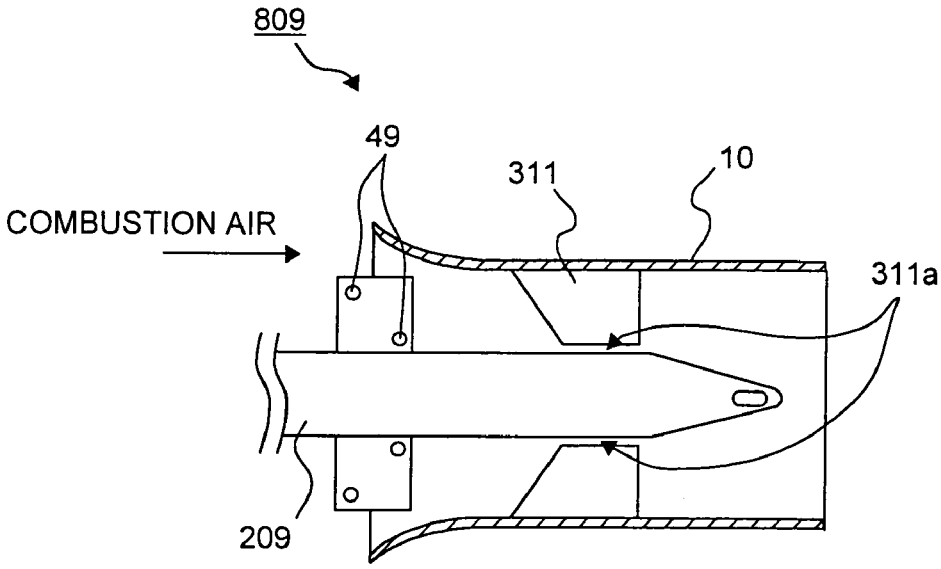
FIG. 10 shows a premixing nozzle according to a fifth embodiment of the present invention.
Figure 10:
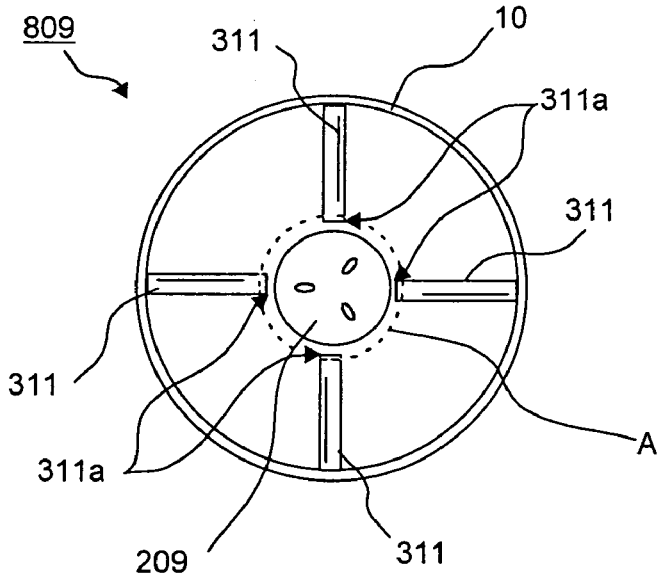

FIG. 10 shows a premixing nozzle according to a fifth embodiment of the present invention. This premixing nozzle has a feature in that a hub for swirler is not used, but a fuel nozzle shaft is arranged in a space surrounded by a plurality of swirler blades having open ends. Each one end of the swirler blades 311 is fitted in the nozzle body 10, with the other ends being open, respectively. The fuel nozzle shaft 209 is arranged in the space (a portion enclosed by A in FIG. 10(*b*)) surrounded by the open ends 311*a* of the swirler blades 311.

Figure 14:
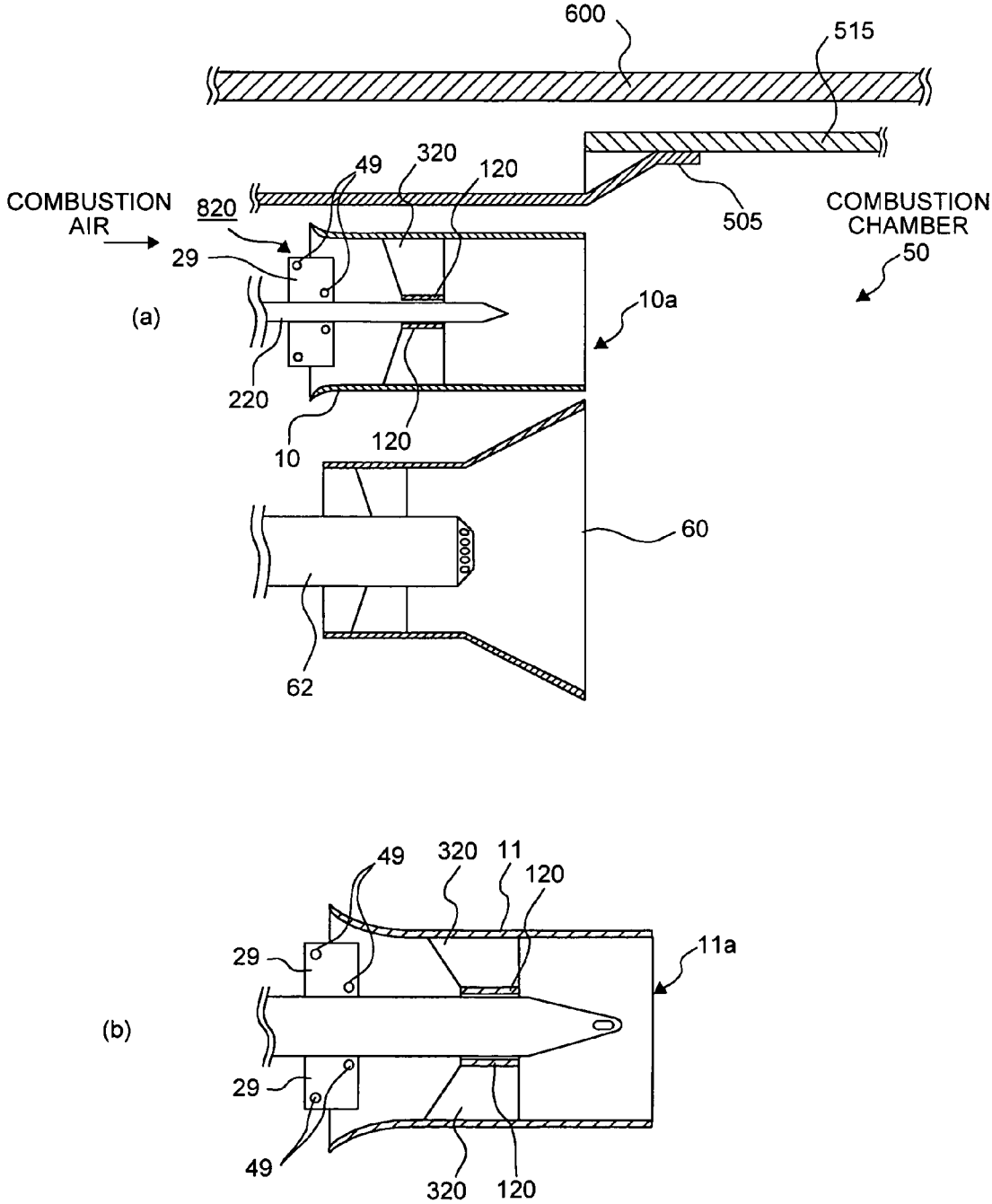
FIG. 14 shows a premixing combustor and a premixing nozzle in a gas turbine used heretofore.

A part of the combustion air as the combustion gas fed from the compressor (not shown), forms a combustion gas together with the gas fuel supplied from gas fuel supply holes 49, and the combustion gas flows to the downstream of the nozzle body 10. The combustion gas is swirled by the swirler blades 311, and becomes a rotational flow directed radially outward of the nozzle body 10 due to the centrifugal force of the swirl. In the conventional premixing nozzle as shown in FIG. 14, the fuel nozzle shaft 220 is arranged inside the hub 120, and therefore the flow of the combustion gas is disturbed by the hub 120, and as a result, the combustion gas does not flow near the center of the nozzle body 10. However, in this premixing nozzle 809, since the hub is not used, the flow of the combustion gas is not disturbed. Further, the combustion gas flows smoothly along the surface of the fuel nozzle shaft 209 without flow separation. Therefore, since the combustion gas also flows near the center of the nozzle body 10, a flow velocity distribution in the nozzle body 10 is balanced. As a result, the flow velocity distribution in the nozzle body 10 is brought close to a uniform state, thereby flashback and NOx can be reduced.

Figure 11:
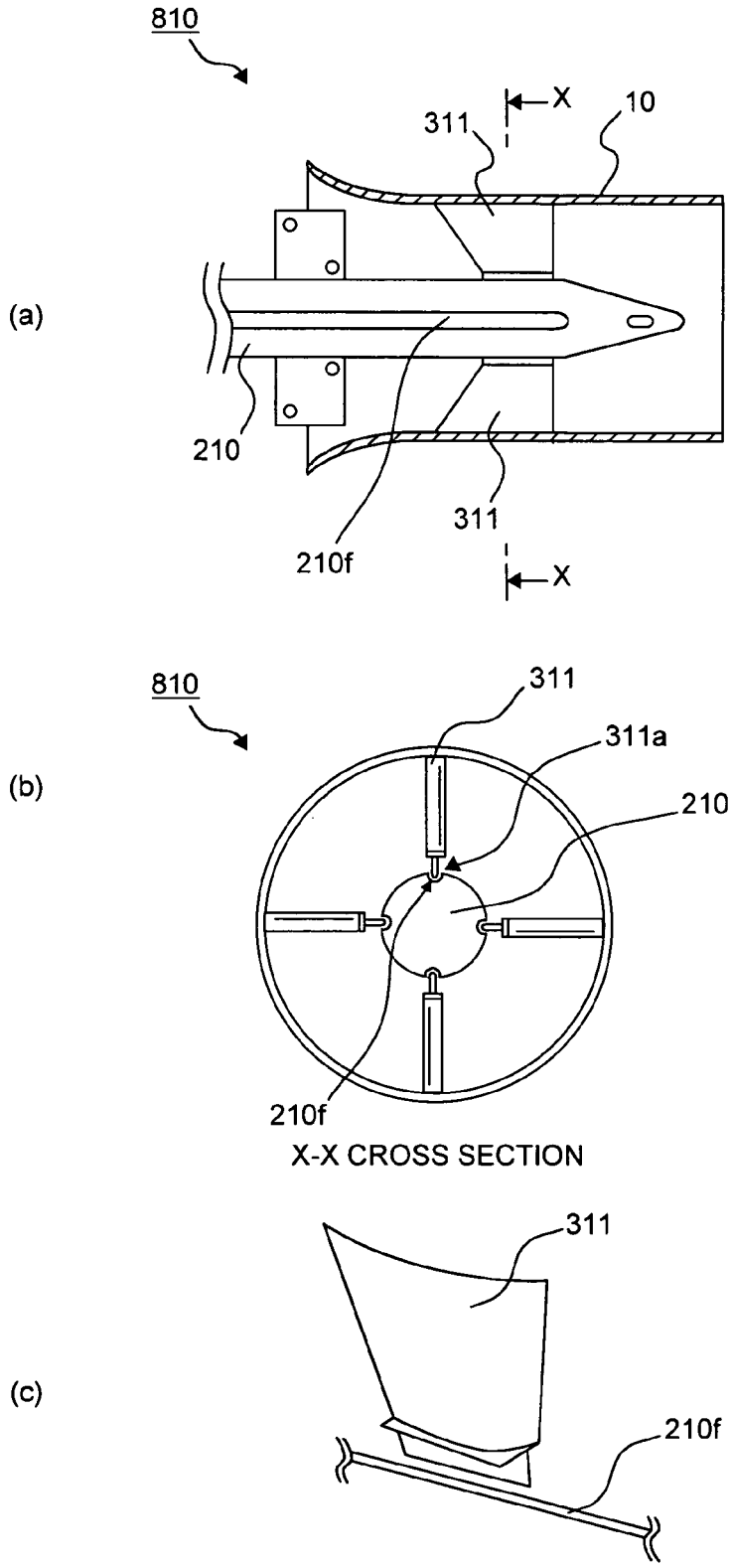
FIG. 11 shows a premixing nozzle according to a modified example of the fifth embodiment.

FIG. 11 shows a premixing nozzle according to a modified example of the fifth embodiment. This premixing nozzle has a feature in that grooves are formed on the surface of the fuel nozzle shaft, and open ends of the swirler blades are inserted into the grooves. Since the premixing nozzle according to the fifth embodiment does not use the hub, the fuel nozzle shaft is held only by the ends of the swirler blades. Therefore, when the fuel nozzle shaft produces vibrations during operation, the vibrations may not be sufficiently suppressed, thereby causing a problem in the fuel supply, or in each section of the combustor. This premixing nozzle is to solve the problem.

Grooves 210*f* for inserting the open ends of the swirler blades are formed on the surface of the fuel nozzle shaft 210. Each one end of the swirler blades 311 is fitted in the nozzle body 10, and the other end is opened, respectively. As in the premixing nozzle 809 according to the fifth embodiment (see FIG. 10), the fuel nozzle shaft 210 is arranged in the space surrounded by the open ends of the swirler blades 311. At this time, the open ends 311*a* of the swirler blades 311 are inserted into the grooves 210*f* formed on the fuel nozzle shaft 210. As shown in FIG. 11(*c*), the open ends 311*a* of the swirler blades 311 may be formed in parallel with the grooves 210*f* formed on the fuel nozzle shaft 210 so that the swirler blades 311 and the fuel nozzle shaft 210 are easily assembled. In this manner, the swirler blades 311 can be easily assembled on the fuel nozzle shaft 210, and hence the assembly work does not require labor hour.

In this premixing nozzle 810, since the fuel nozzle shaft 210 is held by inserting the open ends 311*a* of the swirler blades 311 into the grooves 210*f*, free movement of the fuel nozzle shaft 210 can be suppressed. As a result, the premixing nozzle 810 can obtain an effect that it is highly resistant to turbulence such as vibrations and enables stable combustion regardless of the operation condition in addition to the effect obtained by the premixing nozzle 809 according to the fifth embodiment.

Figure 12:
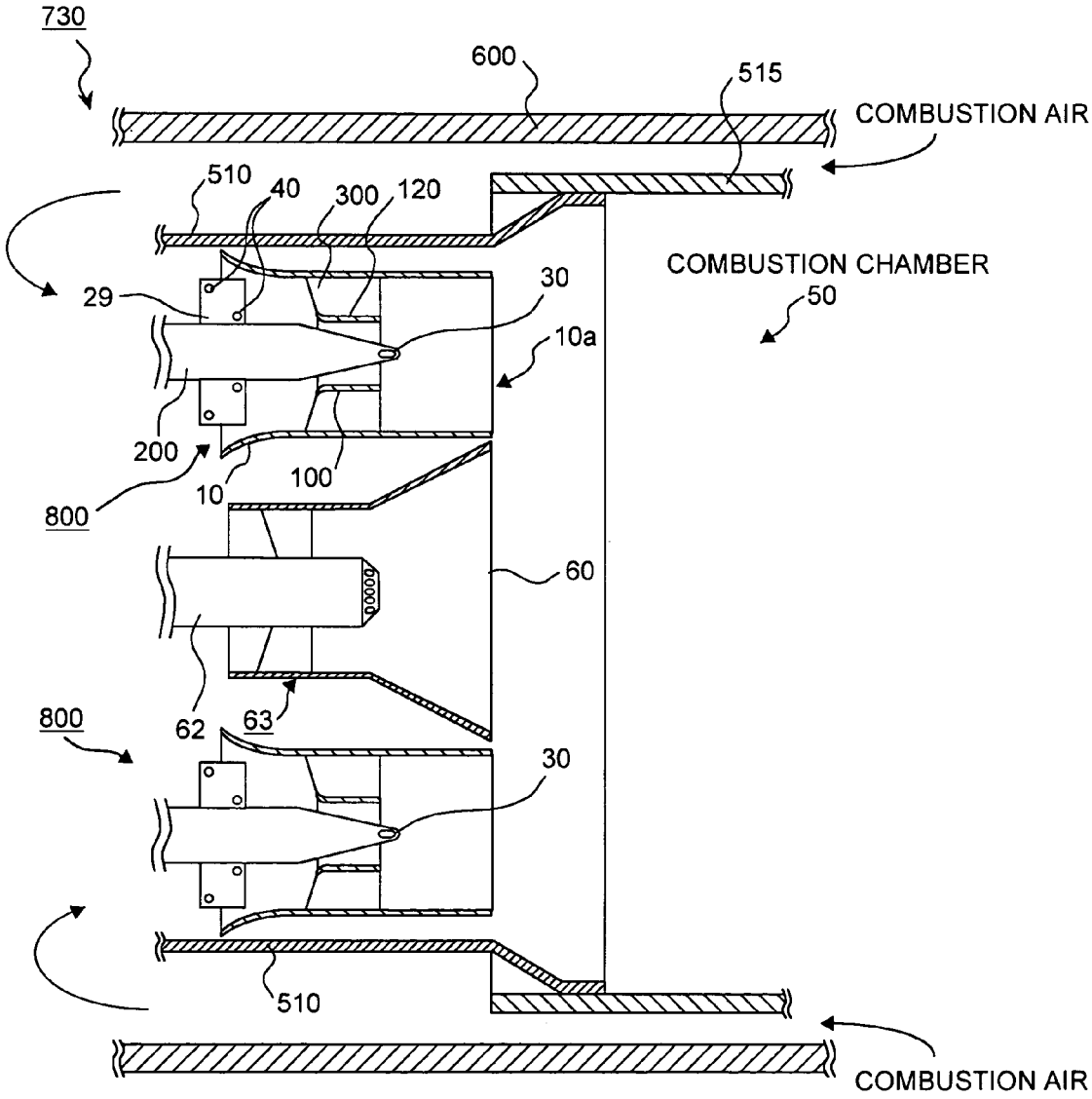
FIG. 12 shows a gas turbine combustor, to which the premixing nozzle of the gas turbine combustor according to the present invention is applied.

In a sixth embodiment, an example in which the premixing nozzle of a gas turbine combustor according to the present invention is applied to the gas turbine combustor and the gas turbine is explained. FIG. 12 shows a gas turbine combustor, to which the premixing nozzle of the gas turbine combustor according to the present invention is applied. This gas turbine combustor 730 includes the premixing nozzle 800 (see FIG. 1) according to the present invention, between a diffusion flame forming nozzle 63 and an inner cylinder of the combustor. Though not clear from FIG. 12, eight premixing nozzles 800 are provided around the diffusion flame forming nozzle 63. This number is not limited to eight, and can be appropriately changed according to the specifications of the combustor and the gas turbine. The premixing nozzle applicable to the combustor 730 is not limited thereto, and any of the premixing nozzles according to the present invention can be applied. An inner cylinder 515 of the combustion chamber is provided at an outlet of an inner cylinder 510 of the combustor, and the cylindrical space surrounded by the inner cylinder 515 of the combustion chamber forms the combustion chamber 50. The combustor casing 600 is provided outside the inner cylinder 510 of the combustor and the inner cylinder 515 of the combustion chamber, thereby the inner cylinder 510 of the combustor and the inner cylinder 515 of the combustion chamber are held.

Figure 13:
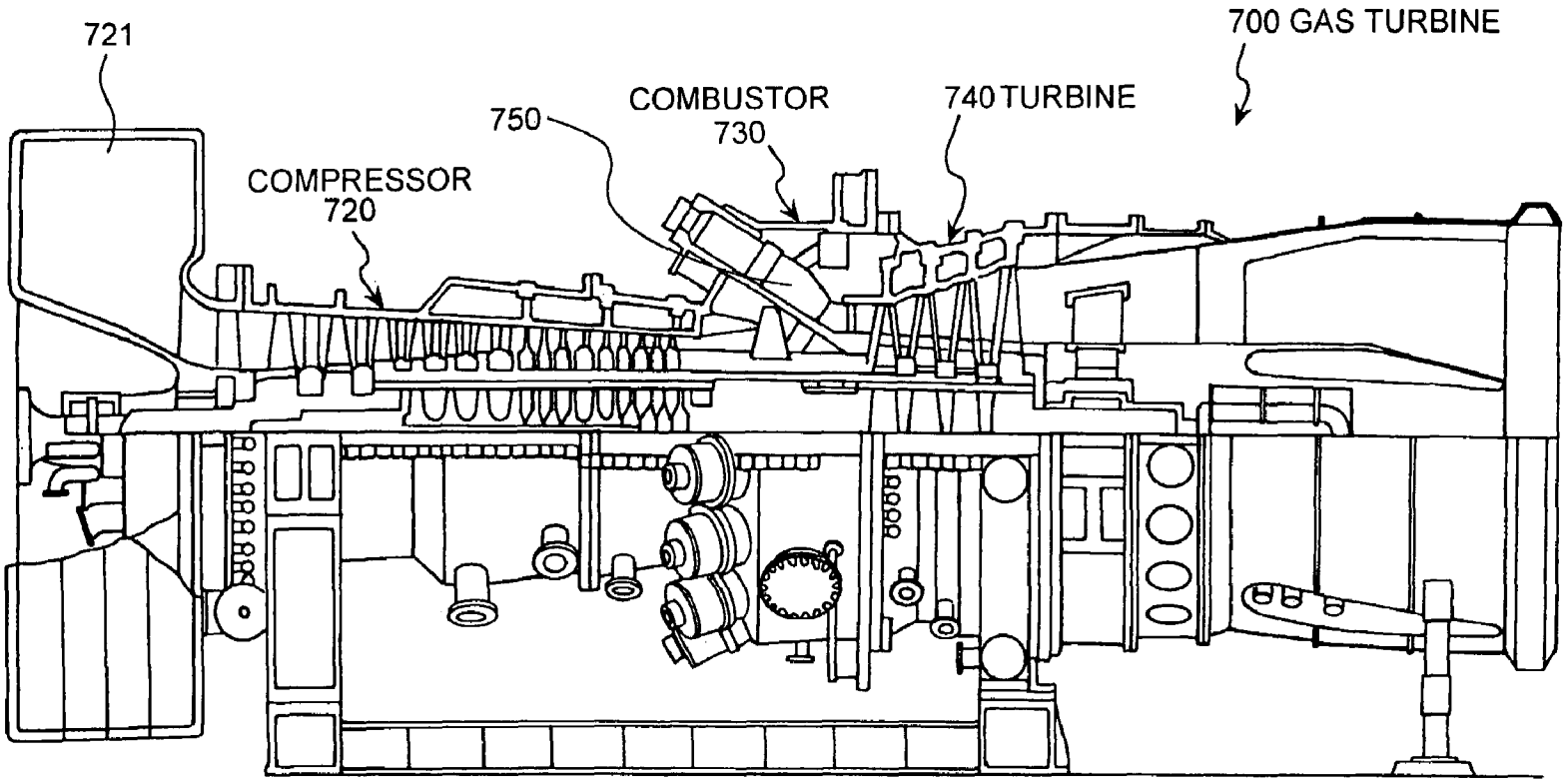
FIG. 13 is a partial cross section of a gas turbine, to which the premixing nozzle of the gas turbine combustor according to the present invention is applied.

FIG. 13 is a partial cross section of a gas turbine to which the premixing nozzle of the gas turbine combustor according to the present invention is applied. This gas turbine 700 includes a compressor 720 that compresses introduced air to produce combustion air, a combustor 730 that injects a gas fuel such as natural gas and a liquid fuel such as light oil to the combustion air fed from the compressor 720 to generate a high temperature combustion gas, and a turbine 740 that generates a rotational driving force by the combustion gas. The combustor 730 is the above-described combustor 730.

The operation of the gas turbine combustor and the gas turbine is explained with reference to FIG. 12 and FIG. 13. The compressor 720 of the gas turbine 700 is connected to the turbine 740, and is driven by the rotation of the turbine 740, to compress the air taken in from a compressor inlet 721. Most of the air compressed by the compressor 720 is used as the combustion air, and the remaining compressed air is used for cooling members with high temperature such as a rotor blade, a stationary blade, or a tailpipe of the gas turbine.

The combustion air fed from the compressor 720 passes through between the combustor casing 600 and the inner cylinder 510 of the combustor, and flows into the premixing nozzle 800 and the diffusion flame forming nozzle 63 from the inlet of the inner cylinder 510 of the combustor. The diffusion flame forming nozzle 63 includes a pilot fuel supply nozzle 62 in the central part thereof, and a pilot fuel is injected from this nozzle to the combustion air to form the diffusion flame. Further, a diffusion flame forming corn 60 is provided at the outlet of the diffusion flame forming nozzle 63, and the diffusion flame is injected from this corn into the combustion chamber 50.

The compressed air flowing into the premixing nozzle 800 is swirled by the swirler blades 300 and flows in the nozzle body 10. In this process, the compressed air is sufficiently mixed with the gas fuel supplied from the gas fuel supply holes 40 and the liquid fuel supplied from the liquid fuel supply holes 30, to form a premixed gas. Thereafter, the premixed gas is injected from the outlet 10*a* of the nozzle body 10 into the combustion chamber 50, and ignited by the diffusion flame formed by the pilot corn 60 to form the premixed flame. In the premixed combustion, the air is burnt in an excess condition with respect to the fuel, and therefore the flame temperature can be made lower than the diffusion combustion, thereby occurrence of NOx can be suppressed.

Since the premixing nozzle according to the present invention is used in this combustor 730, a backflow of the premixed gas is suppressed to suppress flashback, and hence the premixed flame can be formed stably. Further, in this combustor 730, since a backflow of the premixed gas hardly occurs, the premixed gas burns stably in the combustion chamber 50. Therefore, the fuel and the combustion air are sufficiently mixed while the fuel is supplied and reaches the combustion chamber 50, and hence a portion where the fuel concentration is high hardly exists in the premixed gas as the mixed gas of these. As a result, when the premixed gas is burnt, production of a locally high temperature portion is suppressed; thereby occurrence of NOx can be further reduced.

The high temperature and high pressure combustion gas generated from the premixed flame is guided from the combustion chamber 50 to the combustor tailpipe 750, and injected to the turbine 740. The turbine 740 rotates due to the combustion gas to thereby generate a rotational power. A part of the power is consumed for driving the compressor 720, and the remaining power is used for driving an electric generator and the like. The combustion gas having driven the turbine 740 is exhausted as an exhaust gas to the outside of the turbine. Since this exhaust gas still keeps high temperature, the thermal energy thereof can be recovered by an HRSG (Heat Recovery Steam Generator).

Since the premixing nozzle according to the present invention is used, the gas turbine suppresses flashback to enable stable operation. Since the premixing nozzle according to the present invention can also obtain the effect of suppressing occurrence of NOx, the environmental burden can be reduced. Further, the flashback is suppressed to suppress burning of the combustor and the like. As a result, the life of the combustor and the like is prolonged, and the labor hour for the maintenance can be reduced. As a result, the plant using this gas turbine can extend the actual operating time, thereby enabling flexible operation adapted to the demand.

As explained above, in the premixing nozzle according to the present invention, a space where the combustion gas is passed is provided between the fuel nozzle shaft for supplying the fuel and the hub connected to the swirler blades. Therefore, the combustion gas passes through the space and flows to the central part of the nozzle body, and hence the flow velocity in this part can be increased. As a result, burning of the premixing nozzle can be suppressed by bringing the flow velocity distribution of the combustion gas in the nozzle body close to a uniform state to reduce the risk of flashback.

In the premixing nozzle according to the next invention, the tip portion of the fuel nozzle shaft, tapered toward the outlet of the nozzle body, is arranged inside the hub, and the combustion gas is allowed to pass through the space formed between the tip of the fuel nozzle shaft and the hub. Therefore, the space through which the combustion gas passes can be made sufficient, while ensuring the length of the swirler blades, and hence the flow velocity of the combustion gas in the central part of the nozzle body can be increased, while the combustion gas is strongly swirled. As a result, the occurrence of flashback can be suppressed, and the fuel and the combustion air can be sufficiently mixed by the strong swirl, thereby enabling suppression of NOx. Further, the position of the fuel nozzle shaft needs only to be moved toward the outlet side of the nozzle body, and therefore a large design change is not necessary.

In the premixing nozzle according to the next invention, since a part of the fuel nozzle shaft is tapered and this part is arranged inside the hub, the space for passing the combustion gas, formed between the fuel nozzle shaft and the inner peripheral surface of the hub, becomes constant with respect to the flow direction of the combustion air. Therefore, the sectional area in this space where the combustion gas passes becomes substantially constant, and therefore the flow velocity of the combustion gas passing through this space hardly decreases. Hence, in this premixing nozzle, the flow distribution in the nozzle body can be made more uniform, as compared with the above premixing nozzles. As a result, the occurrence of flashback can be further suppressed.

In the premixing nozzle according to the next invention, since the diameter of the hub is decreased toward the downstream of the nozzle body, the sectional area between the nozzle body and the hub increases toward the downstream of the nozzle body. Therefore, the flow velocity of the combustion gas passing through the swirler blades decreases at the outlet of the swirler blades. Hence, a velocity difference between the flow velocity of the combustion gas passing through the swirler blades and the flow velocity of the combustion gas passing between the fuel nozzle shaft and the inner peripheral surface of the hub can be reduced. As a result, a flow velocity distribution inside the nozzle body becomes more uniform than in the above premixing nozzles, and hence a risk of flashback can be further suppressed.

In the premixing nozzle according to the next invention, a part of the fuel nozzle shaft is made thin, and the thin portion of the fuel nozzle shaft is arranged inside the hub tapered toward the downstream. Therefore, the flow velocity of the combustion gas passing between the nozzle body and the hub becomes slower on the outlet side than on the inlet side of the hub, and the flow velocity of the combustion gas passing between the hub and the fuel nozzle shaft becomes faster on the outlet side than on the inlet side of the hub. Therefore, a difference between these flow velocities decreases in the downstream of the swirler, and a flow velocity distribution inside the nozzle body in the downstream of the swirler blades becomes more uniform than in the above premixing nozzles. As a result, in this premixing nozzle, the risk of flashback can be further suppressed than in the above premixing nozzles, and the life of the premixing nozzle can be prolonged.

In the premixing nozzle according to the next invention, since the tip of the fuel nozzle shaft is arranged in the upstream of the inlet of the hub, the flow rate of the combustion gas flowing inside the hub can be increased. Therefore, a flow velocity distribution inside the nozzle can be brought close to a uniform state, and hence the occurrence of flashback can be suppressed by suppressing a backflow of the premixed gas to the low velocity region existing inside the conventional premixing nozzle, and burning of the premixing nozzle can be suppressed by suppressing occurrence of the flashback.

In the premixing nozzle according to the next invention, a change unit that allows the combustion gas to flow toward the center of the nozzle body is provided in the nozzle body. Therefore, the flow of the combustion gas toward the inner surface of the nozzle body, generated due to the centrifugal force of the swirl, can be directed toward the central part of the nozzle body. As a result, the flow velocity distribution in the nozzle body can be brought close to a uniform state, and a backflow of the premixed gas can be suppressed to suppress flashback.

In the premixing nozzle according to the next invention, the blade tips of the swirler blades are opened to arrange the fuel nozzle shaft in the space surrounded by the open edges. Therefore, no hub exists around the fuel nozzle shaft, and the combustion gas flows smoothly along the fuel nozzle shaft. As a result, the combustion gas is allowed to flow even to the central part of the nozzle body to increase the flow velocity in this part, thereby the flow velocity distribution in the nozzle body can be brought close to a uniform state. As a result, the risk of flashback can be decreased by suppressing the backflow of the premixed gas.

In the gas turbine combustor according to the next invention, since the premixed gas is formed by the premixing nozzle and is burnt, flashback is suppressed, thereby enabling stable operation. Since burning of the combustor can be also suppressed, the life of the combustor is extended, and the labor hour for the maintenance can be reduced.

In the gas turbine according to the next invention, since combustion gas is provided by the gas turbine combustor, flashback is suppressed, thereby enabling stable operation. Further, since flashback can be suppressed, burning of the combustor and the like can be suppressed, to extend the life of the gas turbine combustor, thereby the interval of maintenance can be extended. As a result, in the plant using this gas turbine, the actual operating time can be extended, thereby enabling an operation adapted to the demand.

INDUSTRIAL APPLICABILITY

The premixing nozzle, the combustor, and the gas turbine according to the present invention are useful for gas turbines, and suitable for suppressing the occurrence of flashback to suppress burning of the premixing nozzle and the combustor.

The invention claimed is:

1. A premixing nozzle for a gas turbine combustor, comprising:

a swirler blade positioned inside a nozzle body;

a tube-shaped hub that is connected to the swirler blade, wherein a combustion gas is passed through a hollow portion of the hub;

a fuel nozzle shaft that is located inside the nozzle body and that is coaxial with the hub, wherein the fuel nozzle shaft is configured to have a tip portion which is tapered toward a tip of the fuel nozzle shaft and arranged inside the hub having a gap larger than 3 mm between the fuel nozzle shaft and the hub; and hollow gas fuel supply blades fitted in the upstream of the fuel nozzle shaft, wherein gas fuel is configured to be injected from a plurality of gas fuel supply holes provided on the sides of the gas fuel supply blades, to thereby form a combustion gas as a mixed gas of the gas fuel and combustion air.

2. The premixing nozzle according to claim 1, wherein the combustion gas is passed through the gap between an inner surface of the hub and the tip portion of the fuel nozzle shaft.

3. The premixing nozzle according to claim 1, wherein the hollow portion of the hub is tapered with a diameter smaller toward an outlet of the nozzle body as compared to a diameter in the other portion of the hollow portion, the fuel nozzle shaft has a tip portion whose diameter decreases toward an outlet of the nozzle body, the tip portion being arranged inside the hub, and the combustion gas is passed through a space between an inner peripheral surface of the hub and the tip portion.

4. The premixing nozzle according to claim 1, wherein the hollow portion of the hub is tapered with a diameter smaller toward an outlet of the nozzle body as compared to a diameter in the other portion of the hollow portion, the fuel nozzle shaft has a tip portion whose diameter is smaller than that of the fuel nozzle shaft, the tip portion being arranged inside the hub, and the combustion gas is passed through a space between an inner peripheral surface of the hub and the tip portion.

5. The premixing nozzle according to claim 1, wherein the fuel nozzle shaft is arranged outside of the hub.

* * * * *